United States Patent [19]

Tai et al.

[11] Patent Number: 4,741,536

[45] Date of Patent: May 3, 1988

[54] GOLF SWING TRAINING AID

[75] Inventors: William K. Tai, E. 14725 Terra Verde Ct., Spokane, Wash. 99037; Robert Faggioli, Spokane, Wash.

[73] Assignee: William Ku Tai, Spokane, Wash.

[21] Appl. No.: 13,968

[22] Filed: Feb. 12, 1987

[51] Int. Cl.[4] ..... A63B 69/36

[52] U.S. Cl. ..... 273/200 B; 273/195 A; 273/197 R

[58] Field of Search ..... 273/200 B, 184 B, 185 D, 273/197 R, 200 R, 184 R, 185 R, 185 A, 185 B, 197 A

[56] References Cited

U.S. PATENT DOCUMENTS

| | | | |
|---|---|---|---|
| 1,091,985 | 2/1914 | Thompson & Dromgold | 273/200 B |
| 1,690,158 | 1/1928 | Currie | 273/184 B |
| 1,976,405 | 10/1934 | Le Witt | 273/200 B |
| 2,017,661 | 10/1935 | Johanson | 273/200 B |
| 2,641,932 | 6/1953 | Van Kinkle | 273/185 D |
| 3,143,351 | 8/1964 | Bertrand | 273/200 B |
| 3,643,961 | 2/1972 | Schroeder | 273/197 R |
| 3,731,926 | 5/1973 | Vincent | 273/200 B |
| 3,815,922 | 6/1974 | Brainard | 273/200 B |
| 4,023,809 | 5/1977 | Newton | 273/184 B |
| 4,407,503 | 10/1983 | Nishizawa | 273/197 R |

FOREIGN PATENT DOCUMENTS

| | | | |
|---|---|---|---|
| 2951732 | 9/1981 | Fed. Rep. of Germany | 273/184 B |

*Primary Examiner*—George J. Marlo
*Attorney, Agent, or Firm*—Wells, St. John & Roberts

[57] ABSTRACT

A golf-swing practicing apparatus is disclosed which indicates to the golfer when a well-executed practice swing has been made. The apparatus includes a base, a vertical shaft attached thereto, and a spinner which is rotatably mounted relative to the shaft. A support arm, having a golf ball-sized object secured at its free end, is pivotally supported relative to the spinner. This enables upward ascent of the golf ball-sized object relative to the spinner, and enables the spinner to maintain stable rotational movement during such ascent. The spinner includes an elongated channel formed in one of its ends. The channel is upwardly open and downwardly closed by a channel base. The channel enables a more intimate connection of the rigid support arm relative to the channel enabling the apparatus to take a greater number of hits from a golf club without failure, thus extending the life and improving operation of the apparatus.

10 Claims, 3 Drawing Sheets

GOLF SWING TRAINING AID

TECHNICAL FIELD

This invention relates generally to golf-swing practicing devices, and more particularly to such devices capable of serving as a training aid for indicating when a golfer has executed a proper practice swing.

BACKGROUND OF THE INVENTION

Golf-swing practicing devices enable golfers to practice their golf swing when away from the golf course. An ideal golf-swing practicing device should serve as a training aid by both enabling golfers to condition their muscles and to indicate to the golfer when a good golf swing has been executed.

A number of golf-swing practicing devices have been developed. Such devices commonly include some mechanism whereby a ball, after being struck, travels in a circular or spiraling path about an upright pole or post. These devices enable golfers to practice their game indoors or in the confines of, for example, a backyard.

Some such devices include a golf ball which is tethered by a flexible line to an upright post. Upon being hit, the ball and line wrap around the post. Such devices are shown, for example, in U.S. Pat. Nos. 3,143,351 to Bertrand and 3,815,922 to Brainard.

Other such golf practicing devices include a golf ball which is attached at the end of a support arm, the support arm in turn being rotatably mounted to an upright post. Devices such as these are disclosed, for example, in U.S. Pat. No. 1,091,985 to Thompson, et al.; U.S. Pat. No. 3,643,961 to Schroeder; U.S. Pat. No. 2,641,932 to Van Kinkle; U.S. Pat. No. 1,690,158 to Currie; U.S. Pat. No. 4,407,503 to Nishizawa; U.S. Pat. No. 2,017,661 to Johanson; and U.S. Pat. No. 4,023,809 to Newton.

Such devices are not without drawbacks as training aids to indicate to the golfer when he has executed a good golf swing. For example, a well hit golf ball will travel upwardly in a smooth ascending path from which it was hit. Most prior art devices do not indicate to the golfer when such a shot has been properly executed.

For example, U.S. Pat. No. 1,091,985 to Thompson, et al., discloses a spring-armed golf stroke practicing device designed to operate best when the ball is hit to travel in a horizontal plane. If the ball is hit to deviate from the horizontal plane from which it was hit, the rotating device is soon brought to a standstill (lines 80–87). Accordingly, such a device becomes inoperable when a well-executed ascending golf shot has been made.

U.S. Pat. No. 2,641,932 to Van Kinkle discloses a golf game and practicing apparatus having a golf ball secured at the end of a support arm. The ball when hit is raised by centrifugal force and maintained in a raised position such that the support arm remains horizontal.

U.S. Pat. No. 1,690,158 to Currie discloses a golf-swing practicing device having a golf ball rotatably connected to a post through a flexible arm. The ball is supported by a tee for hitting by the golfer. Upon being struck, centrifugal force drives the ball radially outward from the center post and tee, preventing the tee from interfering with the rotation of the ball.

A need remains for an improved golf practicing device capable of accommodating the ascending path of a well hit golf ball while maintaining a desired spinning orientation to indicate to a golfer that a shot has been properly executed.

BRIEF DESCRIPTION OF THE DRAWINGS

The preferred embodiment of the invention is illustrated in the accompanying drawings, in which.

DETAILED DESCRIPTION OF THE PREFERRED EMBODIMENT

Figure 1:
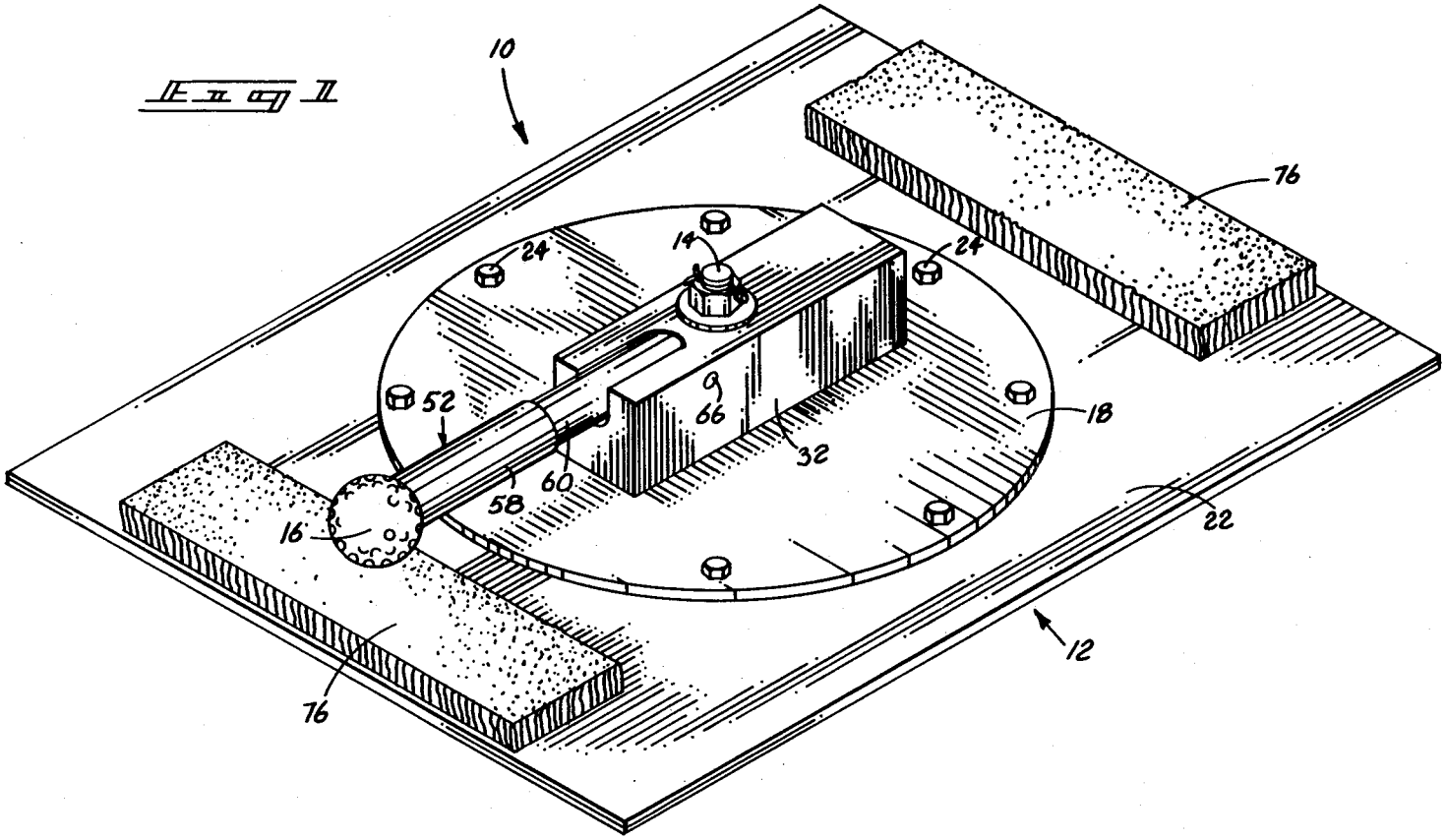
FIG. 1 is a perspective view of a golf-swing practicing apparatus in accordance with the invention.
Figure 2:
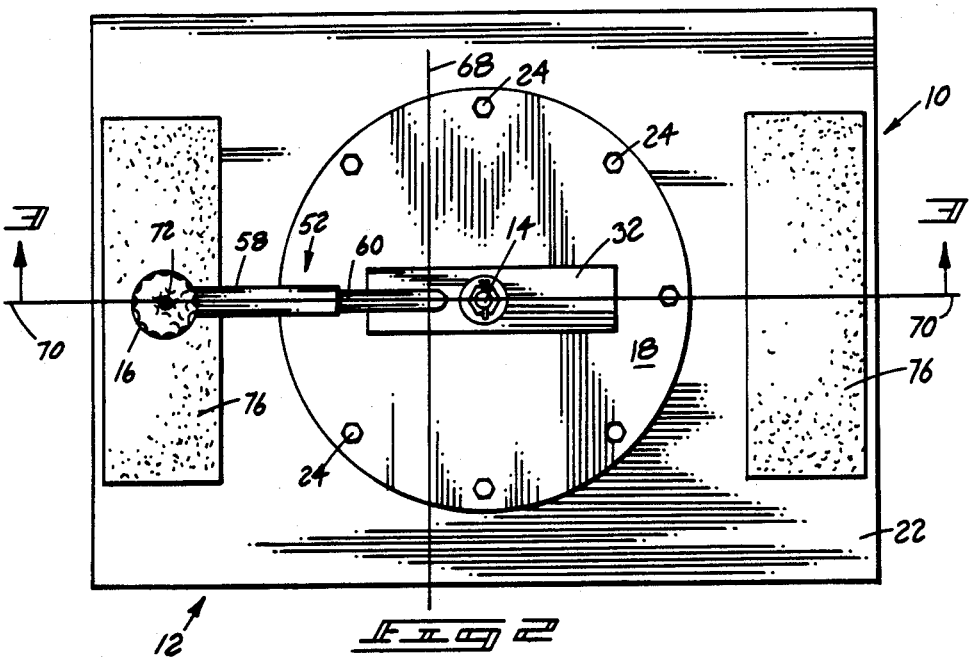
FIG. 2 is a top view of the golf-swing practicing apparatus of FIG. 1.

The following disclosure of the invention is submitted in compliance with the constitutional purpose of the Patent Laws "to promote the progress of science and useful arts" (Article 1, Section 8).

Referring to the Figures, a golf-swing practicing apparatus in accordance with the invention is indicated generally by reference numeral 10. Apparatus 10 includes a base portion 12 having a vertical shaft 14 mounted thereto. A golf ball-sized object 16 is rotationally supported radially relative to shaft 14. Golf ball-sized object 16, upon being struck with a golf club, will revolve about shaft 14, enabling a golfer to practice his swing when confined to a limited practice area. Means are provided to enable the golf ball-sized object to travel in an ascending flight path due to vertical forces imparted to the golf ball-sized object when struck by the golfer.

More particularly, base 12 is comprised of a pair of round metal plates 18, 20 having an enlarged rectangular rubber mat 22 sandwiched therebetween. Plates 18, 20 are centrally oriented relative to mat 22. A plurality of bolts 24 extend through holes formed in the periphery of plates 18, 20, and through holes formed in rubber mat 22, for firmly securing the plates to the mat. Bolts 24 can be threadably received through the holes formed in lower plate 20, or alternatively by nuts threaded onto bolts 24 to bear against the lower surface of lower plate 20.

Shaft 14, in the form of a bolt 26, extends upwardly from upper plate 18. Bolt 26 includes an upper threaded portion 28 and a lower enlarged head portion 30. Head 30 is welded to the center of upper plate 18 such that axis 74 of bolt 26 extends vertically upwards from base 12. Vertical mounting of shaft 14 relative to base 12 is the preferred configuration, although a shaft mounted in a substantially upright manner as opposed to exactly vertical might also be usable.

A spinner or spinner block 32 is rotationally mounted relative to bolt 26 for both clockwise and counterclockwise rotation. In this manner, spinner block 32 is also rotationally mounted relative to base 12. Spinner block 32 is preferably rigid, being formed of metal. As shown, it is square in cross-section and elongated. A hole 34 extends vertically through spinner block 32 for slidably receiving bolt 26. A 'U' cross-sectioned channel 36 is formed in the upper surface of spinner block 32 at one end thereof. Channel 36 is rounded at its innermost end adjacent hole 34. A pair of aligned holes 38, 40 extend laterally through the sides of spinner block 32 and extend to channel 36, for purposes which will be more fully described below.

Spinner block 32 is rotationally supported relative to bolt 26 between upper and lower washers 42, 44. Washers 42, 44 serve to stabilize spinner block 32 for promoting smooth rotation and for minimizing wear. Lower washer 44 bears against bolt head 30. A locking nut 46 having a nylon locking insert 48 is threaded to portion 28 of bolt 26 and bears against upper washer 42. In this manner, vertical movement of spinner block 32 is restricted. A cotter pin 50 extends through holes formed in nut 46, insert 48 and bolt 26 as a further locking safety feature.

A radial support arm 52 is pivotally mounted to spinner block 32. Golf ball-sized object 16 is supported at the free outer end 54 of support arm 52. The opposite or remaining inner end 56 is pivotally received within channel 36 of spinner block 32. More particularly, support arm 52 includes an inner round steel rod 60, and an outer portion 58 having golf ball-sized object 16 formed at its outer end. Rod 60 can also be of other cross-sectional shapes such as square. Outer portion 58 includes an inner central, round core 59 made of a rubber material for simulating the center of a golf ball. A hard Surlyn TM material 63, for simulating the surface of a golf ball, surrounds round core 59 and also extends rearwardly surrounding rod 60. Rod 60 extends to near the center of core 59. The outer end 61 of rod 60 is received within core 59 and is flared, providing an interlocking discontinuity for preventing outer portion 58 from radially ejecting from rod 60 due to centrifugal forces. The foregoing structure simulates the appearance and hardness of a golf ball so that the golfer senses he has hit a true golf ball when practicing with the device. Of course, other simulated golf ball structures could be secured to the end of rod 60 in other manners without departing from the principals and scope of the invention.

The inner end of rod 60, opposite end 61, includes a rounded portion adapted to be received by the rounded inner end of channel 36. Rod 60 further includes a laterally extending hole 64 adjacent its rounded inner end. Hole 64 is the same size as and aligns with holes 38, 40 in spinner block 32. An interconnecting pivot pin 66 extends through holes 38, 64, and 40 and accordingly extends through spinner 32, channel 36 formed therein, and rod 60. With such a construction, support arm 52 is supported relative to spinner block 32 for pivotal movement about a pivot axis 68 defined by pivot pin 66. Pivot pin 66 serves to both enable pivotal movement of support arm 52 relative to spinner 32 and to secure the support arm relative to the spinner. This prevents separation of the support arm and spinner due to centrifugal force imparted when golf ball-sized object 16 is caused to revolve about shaft 14. As shown in the preferred embodiment, pivot axis 68 is both horizontal and perpendicular to a line 70 extending between the center 72 of golf ball-sized object 16 and axis 74 of bolt 26. Additionally, pivot pin 66 and correspondingly pivot axis 68 are radially displaced relative to shaft 14. Alternate configurations of pivot axis 66 could also be employed without departing from the principles and scope of the invention. For example, a spinner block construction could be provided whereby pivot axis 68 is displaced to coincide with axis 74. Further, axis 68 could be displaced to be other than horizontal and perpendicular to line 70.

The construction as shown is one operative example of a means for enabling a golf ball-sized object to elevationally ascend due to vertical forces imparted to the golf ball-size object when struck by a golf club whereby spinner 32 maintains rotational movement during ascent of the golf ball-sized object. Such smooth ascending movement and rotation is not understood to occur with prior art constructions.

Additionally, hole 34 is spaced slightly from the longitudinal center of spinner block 32 toward support arm 52. This offsets, at least partially, eccentric forces imparted the result of the mass of support arm 52 being radially displaced outwardly relative to the spinner block. This helps to stabilize rotation of spinner block 32 and support arm 52 about axis 74.

Figure 3:
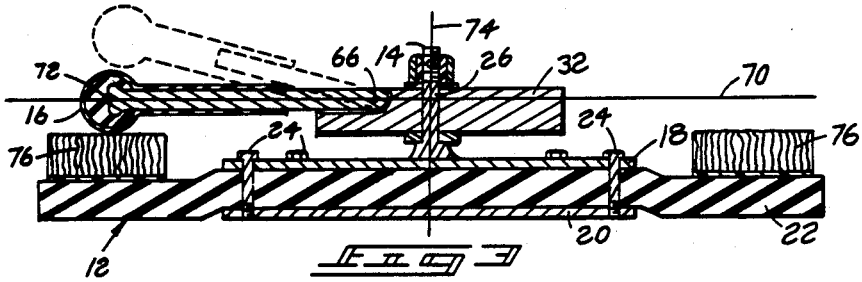
FIG. 3 is a section view taken along line 3—3 in FIG. 2.

Referring to FIG. 3, golf ball sized object 16 is elevationally supported by one of a pair of opposing artificial turf surfaces 76 mounted to and extending upwardly from the upper surface of rubber mat 22. Additionally, the golf-swing practicing mat 12 can be provided with rubber tees which permanently, or removably, extend through artificial surfaces 76 to enable a golfer to practice tee-shots. The upward pivotal movement capability of support arm 52 relative to spinner block 32 enables such placement for practicing either fairway shots or tee shots.

Figure 4:
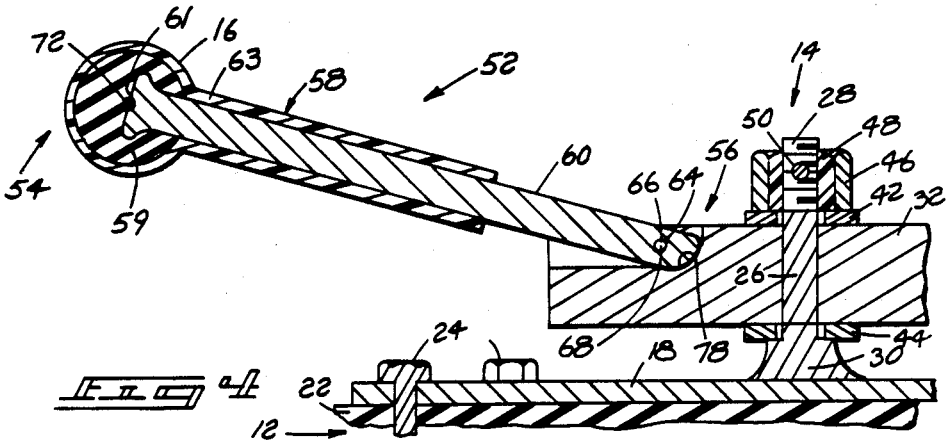
FIG. 4 is an enlarged section view of the golf-swing practicing apparatus of FIG. 1, a golf ball-sized object component of the apparatus being shown in an elevated position.
Figure 5:
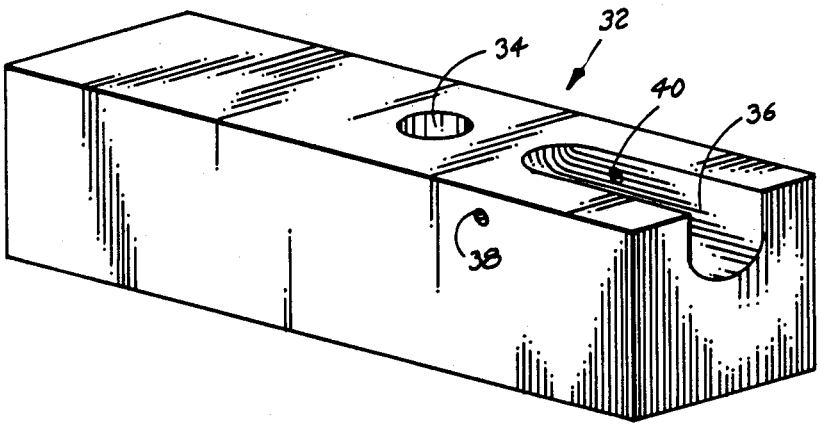
FIG. 5 is a perspective view of a spinner block portion of the apparatus.
Figure 6:
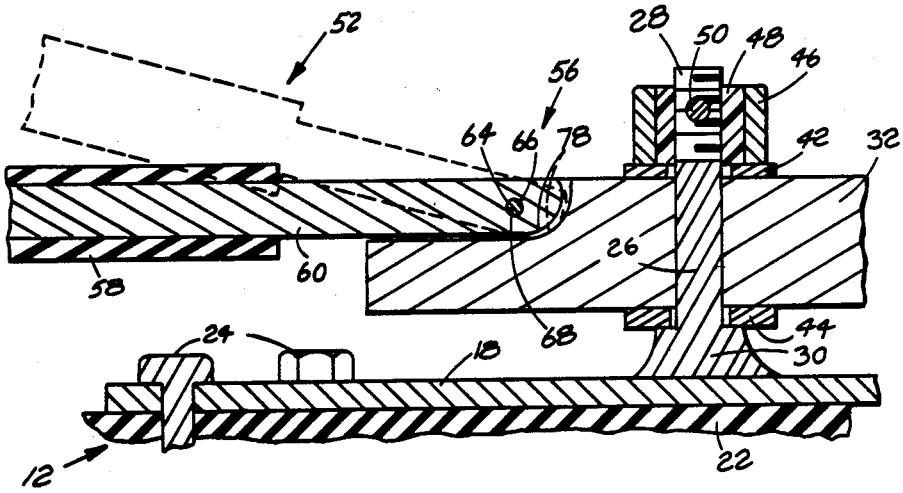
FIG. 6 is an enlarged sectional view of the spinner block and support arm portions of the apparatus taken along line 3—3 in FIG. 2.

In the preferred embodiment, limiting means are also provided for restricting the degree of upward pivotal movement of support arm 52 relative to spinner block 32. As shown in FIGS. 4 and 6, such limiting is achieved by the beveling of lower surface 78 of the innermost end of shaft 60. As shaft 60 pivots upwardly, as illustrated in FIGS. 4 and 6, lower beveled surface 78 will bear against the rear, innermost end of channel 36 which restricts upward pivotal movement of support arm 52 to some predetermined maximum. The predetermined maximum preferably should be between fifteen and twenty degrees. In the depicted FIGS. 1–6 embodiment, beveled surface 78 is provided to limit upward pivotal movement to approximately 15 degrees relative to horizontal.

Figure 7:
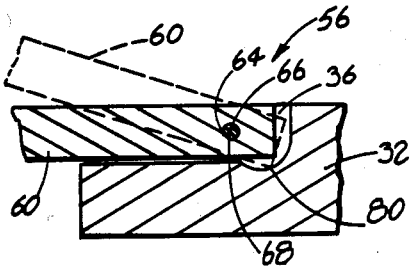
FIG. 7 is an enlarged sectional view of the interconnection area of an alternate embodiment spinner block and support arm in accordance with the invention.

An alternate upward pivotal movement limiting means is illustrated in FIG. 7. Such limiting means is comprised of a recess 80 formed in the base of channel 36 of spinner block 32. Recess 80 is positioned to be inwardly adjacent pivot axis 68 defined by pivot pin 66. Inner or remaining end 56 of support arm 60 pivots into recess 80 until it bears against the base or floor of the recess. In this manner, upward pivotal movement is limited to some predetermined maximum. Alternate limiting means could, of course, be provided without departing from the principles and scope of the invention.

The components of golf-swing practicing apparatus 10 which move relative to one another are preferably manufactured and constructed to provide small clearances. The desired clearance is believed to be between five thousandths (0.005) inch and twenty thousandths (0.020) inch. The preferred clearance is ten thousandths (0.010) inch. These clearance dimensions are applicable to each of (1) the clearance between the side surfaces of shaft 60 and the side walls of channel 36 of spinner block 32; (2) the clearance between pivot pin 66 and both spinner block 32 and shaft 60; (3) the clearance between vertical bolt 26 and spinner block 32; and (4) the tightened clearance between one of washers 42 or 44 and spinner block 32. These tight clearances are understood to provide at least two advantages. First, by minimizing "slop", the wear between moving components is minimized. Second, clearances of the preferred magnitude minimize free spinning of spinner block 32 relative to shaft 14, enabling the golfer to more quickly reset the apparatus for a subsequent practice swing.

OPERATION

The golf-swing practicing apparatus in accordance with the invention will serve as a training aid for golfers, and, when properly used, will provide means to improve or maintain muscle conditioning, hitting proficiency and swing coordination. The apparatus provides the user with a sturdy, long-lasting indoor or outdoor training device. The described embodiment is especially designed to enable the golfer to practice the "sweeping" golf swing employed when using the driver, fairway woods, and long iron shots. The sweeping golf is considered one of the toughest swings to master, but when executed properly can significantly improve the player's score. The invention provides a means for indicating to the golfer when a proper swing has been executed. This is accomplished by the ability of the golf ball-sized object 16 to elevationally ascend while maintaining stabilized rotational movement about shaft 14.

To begin a practice swing, a golfer would first place golf ball-sized object 16 atop one of artificial hitting surfaces 76. Alternatively, golf ball-sized object 16 could be placed atop a tee extending upwardly through artificial surfaces 76 for practicing tee shots, as previously described. The golfer then positions himself to prepare to hit golf ball-sized object 16. As spinner block 32 is adapted for rotation in either clockwise or counterclockwise directions, golf-swing practicing apparatus 10 is easily usable by either left or right-handed golfers. Upon being struck, golf ball-sized object 16 and correspondingly, spinner block 32, will start to revolve about shaft 14. Additionally, due to an upward vertical force imparted to golf ball-sized object 16 by the golf club, support arm 52 will upwardly pivot enabling golf ball-sized object 16 to gradually ascend. The inventive construction enables stable rotational movement of spinner block 32 to be maintained during each ascent. After reaching the uppermost extent of this upward pivoting movement, gravity will force the golf ball to descend while still maintaining stable rotational movement of spinner block 32. As golf ball-sized object 16 reaches its lowermost position while still spinning, it will bear against artificial turf surfaces 76 during rotation causing a braking effect which stops spinner block 32 from spinning. To make a subsequent shot, the golfer merely uses his golf club to position the ball atop the artificial hitting surface.

The above described operation of the apparatus outlines how the apparatus will perform when a well executed golf shot is performed. The ball takes a smooth ascending flight pattern and will freely spin about vertical shaft 14 between five (5) to ten (10) rotations depending on the force of the swing and the club being used. Very poor spinning action and ascent of the ball is obtained if the ball is, for example "topped" or hit downward into the hitting surface. Such bad hits will produce bouncing of the ball or a skidding type of spin with a small number of rotations. Accordingly, the inventive apparatus serves as both a training aid for muscle conditioning and as an indicator when well executed shots have been made.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

We claim:

1. A golf-swing practicing apparatus comprising:

a support base;

a rigid spinner mounted on the base for rotation about a substantially vertical axis, the spinner including a channel formed in one end thereof, the channel being upwardly open, the channel being downwardly closed by a channel base;

a rigid radial support arm having a pair of opposed ends;

a golf ball sized object secured to the support arm adjacent one end thereof;

the remaining end of the radial support arm being pivotally received within the spinner channel for pivotal movement about a horizontal pivot axis that is perpendicular to a line extending between the center of the golf ball sized object and the vertical axis, the horizontal pivot axis extending horizontally through the spinner, channel and radial support arm; and the radial support arm being free to pivot upwardly relative to the spinner to a predetermined maximum angle leading upwardly from the channel base.

2. The golf swing practicing apparatus of claim 1 wherein the channel and horizontal pivot axis are positioned radially from the vertical axis.

3. The golf swing practicing apparatus of claim 1 wherein the channel has a length substantially greater than its width.

4. The golf swing practicing apparatus of claim 1 wherein a recess is formed in the channel base, the remaining end of the support arm being receivable within the recess upon upward pivotal movement relative to the channel, the terminus of the remaining end bearing against the channel base within the recess to define the predetermined maximum angle of the support arm relative to the channel base.

5. The golf swing practicing apparatus of claim 1 wherein the terminus of the remaining end of the support arm is beveled, contact of the beveled portion with the channel base limiting upward pivotal movement to the predetermined maximum angle of the support arm relative to the channel base.

6. The golf ball swing practicing apparatus of claim 1 wherein the predetermined maximum angle is from 15 to 20 degrees.

7. The golf swing practicing apparatus of claim 1 wherein, the channel and horizontal pivot axis are positioned radially from the vertical axis;

the channel has a length substantially greater than its width; and a recess is formed in the channel base, the remaining end of the support arm being receivable within the recess upon upward pivotal movement relative to the channel, the terminus of the remaining end bearing against the channel base within the recess to define the predetermined maximum angle of the support arm relative to the channel base.

8. A golf-swing practicing apparatus comprising:

a support base;

a rigid spinner mounted on the base for rotation about a substantially vertical axis, the spinner including a channel formed in one end thereof, the channel being upwardly open, the channel being downwardly closed by a channel base, the channel having a length substantially greater than its width;

a rigid radial support arm having a pair of opposed ends;

a golf ball sized object secured to the support arm adjacent one end thereof;

the remaining end of the radial support arm being pivotally received within the spinner channel for pivotal movement about a horizontal pivot axis that is perpendicular to a line extending between the center of the golf ball sized object and the vertical axis, the horizontal pivot axis extending horizontally through the spinner, channel and radial support arm; and the radial support arm being free to pivot upwardly relative to the spinner to a predetermined maximum angle of the support arm relative to the channel base reached when the terminus of the remaining end of the support arm contacts the channel base.

9. The golf swing practicing apparatus of claim 8 wherein, the channel and horizontal pivot axis are positioned radially from the vertical axis; and a recess is formed in the channel base, the remaining end of the support arm being receivable within the recess upon upward pivotal movement relative to the channel, the terminus of the remaining end bearing against the channel base within the recess to define the predetermined maximum angle of the support arm relative to the channel base.

10. The golf swing practicing apparatus of claim 8 wherein the spinner is mounted to the base for rotation in a fixed horizontal plane.

* * * * *